United States Patent [19]

Henning

[11] 4,319,934

[45] Mar. 16, 1982

[54] METHOD OF FORMING TOOLS FROM ALLOY STEEL FOR SEVERE COLD FORMING

[75] Inventor: Gary S. Henning, Bloomingdale, Ill.

[73] Assignee: Snap-on Tools Corporation, Kenosha, Wis.

[21] Appl. No.: 160,449

[22] Filed: Jun. 18, 1980

Related U.S. Application Data

[62] Division of Ser. No. 7,971, Jan. 31, 1979, abandoned.

[51] Int. Cl.[3] ..... C21D 8/00

[52] U.S. Cl. ..... 148/12 F; 148/12.4; 148/144

[58] Field of Search ..... 148/12 R, 12 F, 12 B, 148/12.4, 12.1, 134, 12.3, 144

[56] References Cited

U.S. PATENT DOCUMENTS

| | | | |
|---|---|---|---|
| 2,737,455 | 3/1956 | Kirkby et al. | 75/126 P |
| 2,798,805 | 7/1957 | Hodge et al. | 75/126 P |
| 2,861,908 | 11/1958 | Mickelson et al. | 75/123 B |
| 3,093,519 | 6/1963 | Decker et al. | 148/31 |
| 3,364,013 | 1/1968 | Caton | 75/126 H |
| 3,396,013 | 8/1968 | Mihalisin | 75/123 K |
| 3,418,110 | 12/1968 | Goda et al. | 75/124 |
| 3,489,620 | 1/1970 | Current | 148/36 |
| 3,574,602 | 4/1971 | Gondo et al. | 75/126 P |
| 3,595,707 | 7/1971 | Faunce et al. | 148/12.3 |
| 3,615,370 | 10/1971 | Ridal et al. | 75/128 F |
| 3,891,474 | 6/1975 | Grange | 148/144 |
| 3,907,614 | 9/1975 | Bramfitt et al. | 148/36 |
| 4,061,013 | 12/1977 | Kuc et al. | 72/354 |
| 4,076,525 | 2/1978 | Little et al. | 75/123 B |

FOREIGN PATENT DOCUMENTS

| | | | |
|---|---|---|---|
| 1161844 | 8/1969 | United Kingdom | 75/128 F |

*Primary Examiner*—Peter K. Skiff

*Attorney, Agent, or Firm*—Dithmar, Stotland, Stratman & Levy

[57] ABSTRACT

An alloy steel having superior ductility and a low rate of work hardening for use in severe cold forming processes to provide products with high static and dynamic strength, the alloy steel consisting essentially of from about 0.28% to about 0.33% by weight carbon, from about 0.25% to about 0.65% by weight manganese, up to about 0.15% by weight silicon, from about 0.0005% to about 0.0035% by weight boron, from about 0.4% to about 0.7% by weight nickel, from about 0.4% to about 0.6% by weight chromium, from about 0.15% to about 0.25% by weight molybdenum and the remainder being iron with minor amounts of impurities and additional alloying elements; a high strength forged tool made from the alloy steel; and the method of forming high strength forged tools including the steps of providing a solid metal slug of the alloy steel, annealing the metal slug for spheroidization to a hardness in the range $R_B70$ to $R_B76$, cold forming the annealed metal slug into the final shape of the tool, and thereafter heat hardening the formed tool to a hardness in the range $R_C48$ to $R_C52$.

7 Claims, 6 Drawing Figures

METHOD OF FORMING TOOLS FROM ALLOY STEEL FOR SEVERE COLD FORMING

This application is a division of the prior pending application Ser. No. 007,971, filed Jan. 31, 1979 for ALLOY STEEL FOR SEVERE COLD FORMING AND TOOLS MADE THEREFROM AND METHODS OF FORMING TOOLS, now abandoned.

PRIOR ART STATEMENT AND BACKGROUND OF THE INVENTION

The present invention relates generally to methods of forming tools from alloy steels useful in severe cold forming.

Cold forming is a highly economical and low cost method of manufacturing articles of simple to complex shape. One of the major constraints in the cold forming process is the material being formed, since the material must be able to undergo deformation without cracking or splitting in order successfully to manufacture the cold-formed part. The material properties are less stringent when the part being formed requires only limited deformation, but as the cold-formed part becomes more complex in geometry or requires more extensive deformation, the basic material properties must permit extensive flow of the metal to allow manufacture by the cold-forming process.

When the material utilized is steel, good formability, but low finished strength is provided by the use of a steel such as AISI 1008, a killed, low carbon, unalloyed steel, that possesses the ability to flow or be moved into complex shapes without difficulty. As the carbon content increases, to AISI 1021 for instance, the formability by cold forming is reduced, but a higher strength final part is produced. For complex, extensively formed parts, the carbon level in the steel is limited to approximately 0.35% by weight.

While increasing the carbon content of the steel produces higher strength cold-formed components, it is often found that spheroidized annealing is required sufficiently to soften the steel so that it can be adequately formed. Dependent upon the service requirements of the cold-formed component, the medium carbon steels are frequently heat treated to further enhance the mechanical properties of the finished component. Thus, the strength level and physical properties required of a specific component dictates a specific steel composition to be used, and whether it is to be heat treated. Consequently, it is often found that components which could be easily cold formed have service demands that require a steel composition that cannot be sufficiently cold formed to make the part. For example, a socket wrench as illustrated in FIG. 6 of the drawings may be easily formed from AISI 1008, may be produced without difficulty from AISI 1021, and may be produced with considerable difficulty from AISI 1035. Further, the socket wrench may not be able to be economically produced at all from a medium carbon alloy steel, such as AISI 8630, AISI 4140, or the like. Yet, the AISI 1008 socket wrench is of such low strength as to be of no use at all, while the AISI 1021 or the AISI 1035 socket wrenches may be adequate in medium service requirement areas, if heat treated. For a truly high performance socket wrench, one which will undergo repeated impact-loading service as found in professional service automotive garages, an alloy steel must be used. Nickel in the alloy steels markedly increases the steels impact performance, and hence a socket wrench made from AISI 8630 steel would outperform the other compositions referred to above.

However, medium carbon alloy steels, such as AISI 8630, do not have sufficient formability to economically produce components with severe deformation requirements, such as a socket wrench cold formed from a solid slug of such a steel. "Formability" results from a suitable combination of yield strength, tensile strength, elongation and reduction of area, such that the steel may be extensively formed without cracking or splitting. It must also be formable at sufficiently low pressure such that the cold-forming tool life is economical. In certain components requiring extreme deformation, the work-hardening rate of the steel is also of importance. Materials with high work-hardening rates require increasing pressures to be progressively deformed to a larger degree. Frequently, the forming operations must incorporate an intermediate annealing step if the component is to be successfully produced, a procedure which is highly uneconomical.

Poor formability of alloy steels as compared to carbon steels may be demonstrated from a comparison of the mechanical properties which contribute to formability. At equal carbon levels, a comparison can be made between AISI 8630 alloy steel and AISI 1030 carbon steel as follows:

| Mechanical Property | 8630 | 1030 |
|---|---|---|
| Tensile Strength, PSI | 87,750 | 67,000 |
| Yield Strength, PSI | 54,000 | 49,000 |
| Elongation, % | 29 | 31 |
| Reduction of Area, % | 59 | 58 |

While yield strength of AISI 8630 alloy steel is only 10% higher than that of AISI 1030 carbon steel, the tensile strength thereof is 31% higher and the elongation is slightly less. The relation of yield strength to tensile strength is an indication of the rate of work hardening, whereby it is seen that AISI 8630 alloy steel has greater deformation resistance and a greater work-hardening rate, coupled with lower elongation before fracture. AISI 8630 alloy steel may not be economically formed because of logarithmic reduction in tool life in proportion to the materials' increased tensile strength as compared to AISI 1030 carbon steel, and therefore, AISI 8630 alloy steel could not replace AISI 1030 carbon steel in the production of cold-formed components without seriously adversely affecting the economy of the process.

Summarizing, if the desired head hardened properties of AISI 8630 alloy steel are to be available in the products formed thereby, such as a socket wrench, the socket wrench must be machined at a rate of about 200 pieces per hour with a material loss amounting to 50% to 60% of the initial starting material. Alternatively, the AISI 8630 alloy steel could be cold formed only if multiple step forming processes were utilized with repeated annealing and forming steps performed sequentially. This method of forming socket wrenches is highly uneconomical.

The alloy steel used in the present invention is essentially a low carbon steel including nickel, chromium and molybdenum as alloying agents. The superior properties of the alloy tool for severe cold forming purposes reside in providing low controlled amounts of manganese, silicon and boron in the alloy steel.

Alloy steels containing manganese and silicon, but in higher or lower concentrations thereof are disclosed in the following U.S. Pat. Nos.: 2,737,455 granted Mar. 6, 1956 to H. W. Kirkby and C. Sykes; 3,093,519 granted June 11, 1963 to R. F. Decker, A. J. Goldman and J. T. Eash; 3,364,013 granted Jan. 16, 1968 to R. L. Caton; 3,396,013 granted Aug. 6, 1968 to J. R. Mihalisin, 3,418,110 granted Dec. 24, 1968 to S. Goda, I. Kimura and H. Masumoto; 3,615,370 granted Oct. 26, 1971 to K. A. Ridal and J. McCann; and 4,076,525 granted Feb. 28, 1978 to C. D. Little and P. M. Machmeier. Certain of these prior alloy steels contain too little manganese for the purposes of the present invention, these including U.S. Pat. Nos. 3,093,519 and 3,418,110. Others of these prior alloy steels contain too much silicon, including the alloy steels disclosed in U.S. Pat. Nos. 2,737,455; 3,364,013; 3,396,013; 3,418,110 and 3,615,370.

The lack of synergistic amounts of manganese, silicon and boron in the prior art alloy steels causes those steels to have a ductility and a rate of work hardening which render those alloy steels unsuitable for extreme cold forming of articles, specifically tools, therefrom. Such severe cold forming requires a superior ductility and a low rate of work hardening of the annealed alloy steel which is not achieved by the alloy steels of this prior art.

There also is disclosed in U.S. Pat. No. 4,061,013 granted Dec. 6, 1977 to J. Kuc and A. Kuc an alloy steel and a method of cold forming that alloy steel to provide a forged tool. The alloy steel of this prior patent does not possess the superior ductility and low rate of work hardening of the alloy steel used in the present invention. This results in large measure from the increased amount of manganese in this prior art alloy steel and the lack of control of the silicon content thereof.

BRIEF SUMMARY OF THE INVENTION

The present invention provides methods of forming tools from an alloy steel having superior ductility and a low rate of work hardening for use in severe cold forming process to provide products, such as tools with high static and dynamic strength.

This is accomplished in the present invention, and it is an object of the present invention to accomplish these desired results, by providing methods of forming tools from an alloy steel having superior ductility and a low rate of work hardening for use in severe cold forming processes to provide products with high static and dynamic strength, the alloy steel consisting essentially of from about 0.28% to about 0.33% by weight carbon, from about 0.25% to about 0.65% by weight manganese, up to about 0.15% by weight silicon, from about 0.0005% to about 0.0035% by weight boron, and the remainder being iron with minor amounts of impurities and additional alloy elements.

Another object of the invention is to provide methods of forming tools from an alloy steel of the type set forth wherein the additional alloy elements comprise from about 0.4% to about 0.7% by weight nickel, or from about 0.4% to about 0.6% chromium, or from about 0.15% to about 0.25% by weight molybdenum, or combinations thereof.

Still another object of the invention is to provide methods of forming a high strength forged tool of the type set forth wherein the alloy steel before cold forming thereof is annealed for spheroidization, and after cold forming thereof is heat hardened to a hardness from about $R_C48$ to about $R_C52$.

A further object of the invention is to provide a method of forming tools by severe cold forming of an alloy steel of the type set forth, the method being devoid of machining operations and including the steps of providing a solid metal slug having a predetermined volume and made of one of the aforesaid alloy steels, annealing the metal slug for spheroidization to a resultant hardness in the range from about $R_B70$ to about $R_B76$, cold forming the annealed metal slug into the final shape of the tool, and thereafter heat hardening the formed tool to a resultant hardness in the range of about $R_C48$ to about $R_C52$.

Further features of the invention pertain to the particular steps of the method of forming tools from alloy steels useful in severe cold forming thereof.

The invention, both as to its organization and method of operation, together with further features and advantages thereof will best be understood with reference to the following specification taken in connection with the accompanying drawings.

DESCRIPTION OF THE PREFERRED EMBODIMENTS

The alloy steel used in the methods of the present invention has superior ductility and a low rate of work hardening which renders the alloy steel ideal for use in severe cold-forming processes to provide products with high static and dynamic strength. Examples of such products are tools which are subjected in use of high static and dynamic forces which tend to distort the tool unless the strength of the tool is sufficient to resist such distortion. A tool typical of those formed by severe cold forming is illustrated in FIG. 6 of the drawings, and the method of formation of such a tool by severe cold forming is diagrammatically illustrated in FIGS. 1 through 6 of the drawings.

Figure 6:
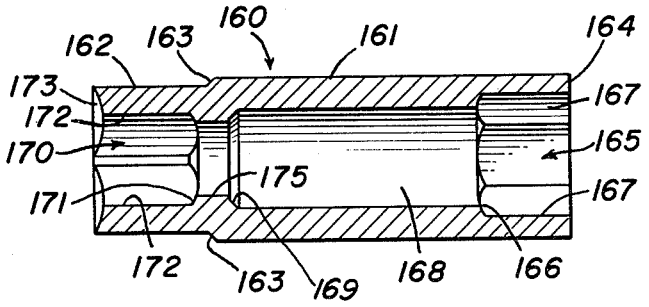
FIG. 6 is a view in longitudinal section through the metal slug after final formation thereof to form a socket wrench made in accordance with and embodying the principles of the present invention.

More specifically, there is illustrated in FIG. 6 of the drawings a socket wrench 160 having a first larger outer side wall 161 and a smaller outer side wall 162 joined by an inclined outer wall 163. One end of the socket wrench 160 is provided with an outer end wall 164 in which is formed a hexagonally shaped recess 165 that terminates in an inner end wall 166 and is provided with six side walls 167 that cooperate to form the hexagonal recess 165. The recess 165 is centered longitudinally about the center line of the socket wrench 160, and in longitudinal alignment with the hexagonal recess 165 is a bolt clearance recess 168 terminating in an inclined end wall 169. The other end of the socket wrench 160 has an outer wall 173 in which is formed a square tool-receiving recess 170. The recess 170 has an inner end wall 171 and four side walls 172 defining the recess 170. Joining the square tool-receiving recess 170 and the bolt clearance recess 168 is a circular opening defined by a circular wall 175 that interconnects the inner end wall 166 and the inner end wall 171.

An important aspect of the present invention is the provision of a tool forming method using an alloy steel having superior ductility and a low rate of work hardening for use in cold forming the socket wrench 160 of FIG. 6, i.e., extrusions with a length to diameter ratio of over 3:1. The following is a preferred composition of the alloy steel used in forming the socket wrench 160:

| Ingredient | % By Weight |
|---|---|
| Carbon | 0.32 |
| Manganese | 0.58 |
| Phosphorous | 0.007 |
| Sulfur | 0.008 |
| Silicon | 0.10 |
| Nickel | 0.53 |
| Chromium | 0.50 |
| Molybdenum | 0.14 |
| Boron | 0.0018 |
| Iron | Balance |

The following is the composition of a prior art standard AISI 8630 alloy steel:

| Ingredient | % By Weight |
|---|---|
| Carbon | 0.28–0.33 |
| Manganese | 0.70–0.90 |
| Phosphorous | 0.025 Max |
| Sulfur | 0.025 Max |
| Silicon | 0.20–0.35 |
| Nickel | 0.40–0.70 |
| Chromium | 0.40–0.60 |
| Molybdenum | 0.15–0.25 |
| Iron | Balance |

The markedly improved properties of the alloy steel used in the present invention result from the reduced manganese content and the reduced silicon content thereof as compared to the prior art alloy steel in combination with the addition of the boron. The following is a table showing the physical properties of two prior art steels and alloy steel used in the present invention after annealing thereof in preparation for cold forming:

| Physical Property | Prior Art AISI 1030 | Prior Art AISI 8630 | Alloy Steel of the Present Invention |
|---|---|---|---|
| Tensile Strength, PSI | 67,000 | 87,750 | 68,650 ± 2,000 |
| Yield Strength, PSI | 49,000 | 54,000 | 41,290 ± 2,000 |
| Elongation, % | 31 | 29 | 30 ± 1 |
| Reduction of Area, % | 58 | 59 | 72 ± 2 |

In forming tools such as the socket wrench 160 using an alloy steel such as the prior art AISI 8630, the tool is typically machined at a rate of 200 pieces per hour with a material loss amounting to 50% to 60% of the initial starting material. The AISI 8630 alloy steel could be cold formed only if multiple step forming processes were utilized with repeated annealing and forming steps being performed sequentially. This method of forming tools such as the socket wrench 160 from the prior art alloy steel AISI 8630 was highly uneconomical.

By contrast, the alloy steel used in the present invention can be cold formed at the rate of about 3,000 pieces per hour to form the socket wrench 160. The material loss is about 6% by weight of the starting material, substantially less loss than using the machining method on the prior art steel such as AISI 8630. Furthermore, the resultant socket wrench 160 formed from the alloy steel used in the present invention is essentially stronger, and particularly about 10% stronger in static strength and about 40% stronger in dynamic strength.

In manufacturing the socket wrench 160 using the alloy steel used in the present invention, the alloy steel was first formed into a wire and then annealed for spheroidization. The annealing cycle consisted of austenitizing at 1390° F., holding at that temperature for three hours, and thereafter cooling from that temperature at 15° F. per hour for about ten hours. The resultant annealed alloy steel had a hardness in the range $R_B70$ to $R_B76$. Analysis of the annealed alloy steel revealed that it was 70% spheroidized, 15% fine spheroids and granular carbides, and 15% lamellar pearlite in colonies. By annealing slightly less, an alloy steel was provided having a hardness in the range $R_B83$ to $R_B86$ which was 20% spheroidized, and 70% fine and granular carbides. The preferred annealed alloy steel is at least 80% spheroidized, with coarse spheroidization desirable. The annealed alloy steel is then phosphate coated, bonderized and lubricated in the usual manner.

Figure 1:
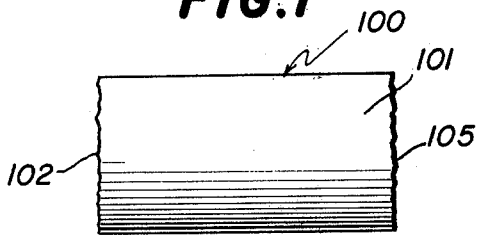
FIG. 1 is a side elevational view of a metal slug formed of the alloy used in the present invention and useful in forming a tool of the present invention by severe cold forming thereof using the method of the present invention.

A slug 100, as illustrated in FIG. 1, was cut from a roll of the annealed alloy steel (which was phosphated and bonderized) as a first step in the cold-forming operation, the slug 100 having a diameter of 17.8 mm. with a tolerance of −0.1 mm., the diameter being slightly less than the finished diameter of the socket wrench 160 of FIG. 6. The length of the slug 100 is about 33.2 mm. As illustrated, the slug 100 has a cylindrical side wall 101 and two sheared surfaces providing end walls 102 and 105. The sheared surfaces 102 and 105 were exceptionally clean and uniform with no tearing, indicating excellent material homogeneity.

The slug 100 was then fed to an automated transfer press of 500 ton capacity operating at a speed of 55 strokes per minute. Consequently, 55 finished socket wrenches 160 were produced per minute, a slug 100 being fed with every stroke. An extrusion oil was used composed of 12% sulfur as sulfurized fat in a high flash mineral oil.

Figure 2:
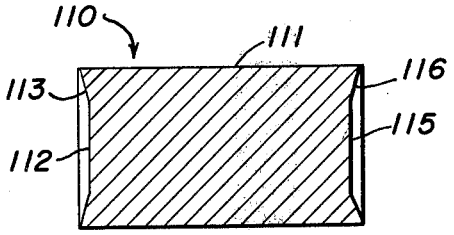
FIG. 2 is a view in longitudinal section of the metal slug of FIG. 1 after the ends thereof have been upset.

In the first step in the cold-forming operation, an upset operation was used to square the slug and to produce truncated conical surfaces at the ends thereof to produce the piece illustrated in FIG. 2, this being an upset slug 110. The slug 110 had a cylindrical side wall 111 with a diameter of 18.2 mm., a first end surface 112 and a second end surface 115, each being joined respectively to a truncated conical surface 113 and a truncated conical surface 116. The upset operation was carried out by applying up to 200,000 PSI pressure at this die station, whereby the sheared surfaces 102 and 105 are essentially smooth and provided with truncated conical surfaces of good finish to aid the extrusion in further dies by the entrapment of extreme pressure lubricant through the uses of progressively shorter truncation of the conical punch faces. The conical surfaces 113 and 116 also permit centering of the punch as the extrusion begins, providing components of better concentricity and avoiding loading of the extrusion punches in a bending moment.

Figure 3:
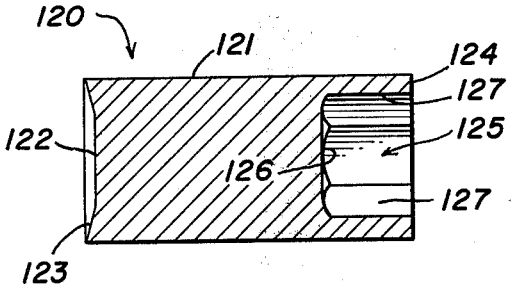
FIG. 3 is a view in longitudinal section of the metal slug of FIG. 2 after one end thereof has had a hexagonal recess extruded thereinto.

The upset slug 110 was then moved to a station where one end thereof had a hexagonal recess formed therein to provide a hex extruded slug 120 illustrated in FIG. 3. The hex extrusion is performed in a single blow, having an extrusion ratio of 55%, where the extrusion ratio is defined as the difference between the initial area and the final area divided by the initial area. The hex extruded slug 120 had an overall length of approximately 37 mm. and is provided with a cylindrical side wall 121 having a diameter of 18.2 mm. One end surface 122 is provided having a truncated conical surface 123 shaped much like the end surface 112 and the truncated conical surface 113 of the upset slug 110. The other end of the slug 120 has the hexagonal recess 125 therein provided with an outer end wall 124 and an inner end wall 126. The recess 125 is essentially defined by six rectangular side walls 127. The distance across the flats of the recess 125 is 12.9 mm. and the depth of the recess 125 is 10.2 mm.

The outer lip at the outer end 124 of the hexagonal extrusion forming the recess 125 was entirely free of tears or cracks. This type of defect is very common when extruding prior art materials, particularly where hexagonal or square punches are used, because of the disparity of metal flow velocities adjacent to the corners of the punch.

Figure 4:
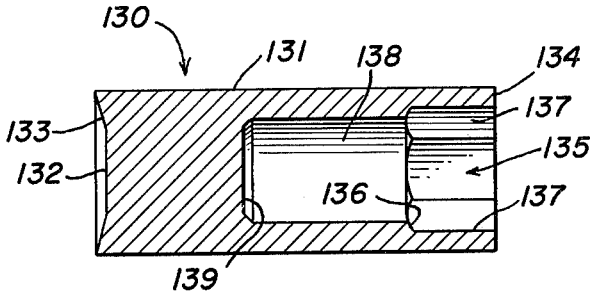
FIG. 4 is a view in longitudinal section of the metal slug of FIG. 3 with a bolt clearance recess partially extruded therein in alignment with the hexagonal recess.
Figure 5:
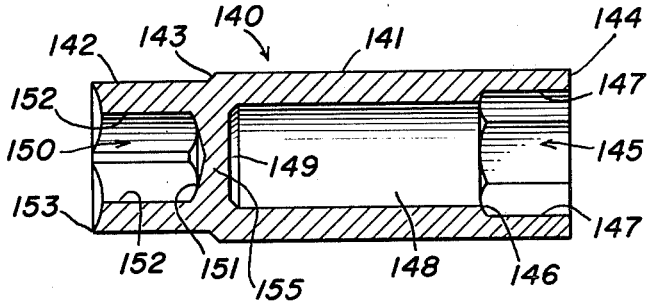
FIG. 5 is a view in longitudinal section of the metal slug of FIG. 4 after a combination forward-backward extrusion of a square recess in the other end thereof and a further extrusion of the bolt clearance recess therein.

The hex extruded slug 120 was then subjected at the next extrusion station to a partial extrusion of a bolt clearance recess 138, see FIG. 4. The bolt clearance extrusion forming the recess 138 has an extrusion ratio of 43%, and was readily performed on the equipment used. The depth of the partial extrusion of the recess 138 is empirically determined so that the simultaneous combined forward-backward extrusion pressures at the next step illustrated in FIG. 5 are nearly balanced. This partial extrusion step provides a slug 130 with both a hexagonal recess 135 therein and the bolt clearance recess 138 therein longitudinally aligned. The slug 130 has a side wall 131 with a diameter of 18.3 mm., a first end surface 132 with a truncated conical surface 133 like the surfaces 122 and 123, respectively, described above. The other end of the slug 130 has an outer end wall 134 in which the hexagonal recess 135 is disposed, the recess 135 then terminating in an inner end wall 136 and having six aide walls 137. The diameter across the flats of the hex recess 135 is now 12.6 mm. The bolt clearance recess 138 terminates in an end wall 139, the distance between the end wall 139 and the outer end wall 134 being 27.5 mm. and the overall length of the slug 130 being approximately 45 mm. The external wall of the bolt clearance section of the slug 130 was free of stretch marks and flutes. There were no tears or cracks found in the slug 130, such defects being common when extruding prior art alloy steels because of the disparity of metal flow velocities adjacent to the corners of the punch.

The slug 130 was then subjected at the next extrusion station to a simultaneous forward-backward extrusion to further elongate the bolt clearance recess 138 in the slug 130 and to form therein a square tool-receiving recess 150, see FIG. 5. The combined forward-backward extrusion pressures in forming the slug 140 of FIG. 5 from the slug 130 of FIG. 4 are essentially balanced. This pressure balance permits consistent square punch depth at this cold forming station without overloading the square punch stripper sleeve.

There results from this combined forward-backward extrusion step the slug 140 having an overall length of 54.6 mm., a first side wall 141 having an external diameter of 18.4 mm., a second side wall 142 having an external diameter of 17.4 mm., the side walls 141 and 142 being joined by an inclined wall 143 that forms an angle of about 45° with the longitudinal axis of the slug 140. The right-hand end wall 144 has a hexagonal recess 145 therein with an inner end wall 146 and six side walls 147. The slug 140 also is provided with a bolt clearance recess 148 having an end wall 149 disposed from the end wall 144 about 37.3 mm., the recess 148 having a diameter of about 12.1 mm.

The square tool-receiving recess 150 has an inner end wall 151 spaced from the associated outer end wall 153 about 13.2 mm. and also has four side walls 152 defining the square recess 150 that is 9.7 mm. on a side. There is disposed between the bolt clearance recess 148 and the square tool-receiving recess 150 a web 155. There were no tears or cracks found at the maximum punch penetrations at the walls 149 and 151. This type of defect is very common in extruding prior art alloys, particularly where hexagonal or square punches are used, because of the disparity of metal flow velocities adjacent to the corners of the punch.

The combined forward-backward extrusion illustrated in FIG. 5 requires approximately 260,000 to 280,000 PSI, which approaches the upper working stress of the high speed steel tooling used in forming the punches. It was found when using the alloy steels in the present invention, that the punches have a good tool life. The square extrusion forming the square tool-receiving recess 150 has an extrusion ratio of 32%.

In a modification of the present invention, the partial bolt clearance recess extrusion of FIG. 4 and the combined forward-backward extrusion of FIG. 5 were combined and both recesses formed in a signal blow. Punch life was not shortened despite the severe forces applied to the tools, and the good punch life in this modified step is attributed to the excellent formability of the alloy steel used in the present invention.

As a final step to form the socket wrench 160 of FIG. 6, a fifth operation is performed, this being the piercing of the web 155, thus producing the finished socket wrench 160. The external surface of the socket wrench 160 at the pierced web section, i.e., at the circular wall 175, did not "neck down" as a result of the rapid metal flow of the combined forward-rearward extrusion sequence. There now has been formed an entirely hollow shape from the slug 100 of FIG. 1. Cosmetic facing of the end walls 164 and 173 is normally performed.

The completed socket wrench 160 has an overall length of 54.6 mm., the side wall 161 has a circular diameter of 18.2 mm., the side wall 162 has a circular diameter of 17.4 mm. and a longitudinal length of 13.2 mm. The hexagonal recess 165 has a depth of 9.9 mm. and a distance across the flats of 12.9 mm. The bolt-receiving recess 168 has a diameter of 12.1 mm. and a distance between the walls 164 and 169 of 37.3 mm. The square tool-receiving recess 170 has a depth of 13.2 mm. and each side wall 172 has a width of 9 mm.

The fully formed socket wrench 160 is next hardened to improve the mechanical properties thereof. The hardening cycle includes austenitizing at 1625° F., holding at that temperature for one hour, using a 0.30% carbon endothermic gas atmosphere. The austenitized tool is then quenched in agitated oil and tempered at 400° F. for two hours.

The resultant heat hardened tool has a hardness in the range of $R_C$48–52, a yield strength of 230,000 PSI, a tensile strength of 252,000 PSI, an elongation of 10% and a reduction of area of 45%. The tensile testing was in accordance with ASTM A370 and ASTM E8, while the hardness testing was in accordance with ASTM E18 for the Rockwell hardness. It will be seen therefore that a strong socket wrench 160 has been provided, the socket wrench being 10% stronger in static strength and 40% stronger in dynamic strength as compared to socket wrenches made from prior alloy steels using prior art forming methods.

Finally, the socket wrench 160 may be chromium plated for cosmetic purposes.

While the tool 160 has been illustrated as a socket wrench, it will be appreciated that the alloy steels used in the present invention and the method of forming tools of the present invention may be utilized to form other tools. The present invention is particularly useful in forming tools that require extrusions with a length to diameter ratio of over 3:1, and wherein the tool must have high strength, and particularly high impact strength after heat hardening. It further is pointed out that although a hexagonal recess 165 has been illustrated in one end of the socket wrench 160 and a square recess 170 has been illustrated in the other end of the socket wrench 160, recesses of other cross section can readily be formed from the alloy steels and using the method of the present invention, and even star shaped and other multi-sided, non-polygonal openings may be formed using the alloy steels and the methods of the present invention in forming wrenches such as the socket wrenches 160 illustrated in FIG. 6 of the drawings.

The excellent formability of the alloy steel used in the present invention is attributed to its superior ductility and low rate of work hardening. Defects found in severe cold forming of prior alloy steels result from exceeding the materials' ductility and/or excessive work hardening when attempting to produce the desired extruded component. The superior ductility and low rate of work hardening of the alloy steel used in the present invention is attributed fundamentally to the controlled content of the manganese, silicon and boron therein. The manganese may be present in an amount from about 0.25% by weight to about 0.65% by weight, the preferred range being from about 0.40% by weight to about 0.60% by weight. The manganese functions to reduce "hot shortness" of the alloy steel and also to promote the hardenability thereof. If the amount of manganese present is too low, the alloy steel will be "hot short" in the mill and cannot be formed on standard mill equipment into the necessary rod or wire form. If the amount of manganese in the alloy steel is too high, poor annealing is achieved, and the yield strength of the annealed material is markedly increased, while the ductility of the annealed material is decreased and the work-hardening rate is much higher.

The silicon is present in the alloy steel in the range up to about 0.15% by weight maximum, the preferred upper limit being about 0.10% by weight maximum. The silicon is used to deoxidize the molten steel, and it also promotes hardenability. In the manufacture of this low silicon alloy steel, vacuum deoxidization is utilized. If the amount of silicon present is too high, particularly in combination with the manganese, the yield strength of the resultant alloy steel is increased markedly, while the impact strength and the toughness of the alloy steel are decreased.

The boron is present preferably in the range from about 0.0005% by weight to about 0.0035% by weight, a preferred range being from about 0.001% by weight to about 0.003% by weight. The purpose of the boron content is to increase hardenability and to increase the homogeneity of the alloy steel. If the amount of boron present is too low, the reduced manganese and silicon of the alloy steel gives reduced hardenability upon heat treatment of the formed tool, such as the socket wrench 160. If the amount of boron present is too high, the alloy steel is "hot short" during the working thereof in the standard mill equipment, and the alloy steel becomes brittle and lacks toughness.

In the alloy steel used in the present invention, the carbon content may be in the range from 0.28% by weight to about 0.33%, by weight, the preferred inner range being from about 0.29% by weight to about 0.31% by weight. The phosphorous may be present in an amount as great as 0.025% by weight maximum, the preferred maximum content being 0.015% by weight. The sulfur may be present in an amount up to 0.025% by weight maximum, the preferred maximum content being 0.015% by weight.

Among the alloy elements, nickel may be present in an amount from about 0.4% to about 0.7% by weight, the preferred range being from 0.45% by weight to about 0.55% by weight. The chromium may be present in an amount from about 0.4% by weight to about 0.6% by weight, the preferred inner range being from 0.45% by weight to about 0.55% by weight. The molybdenum may be present in an amount from about 0.15% by weight to about 0.25% by weight, the peferred inner range being from about 0.20% by weight to about 0.25% by weight. Vanadium may be added as an alloy agent or may be substituted for one of the other alloying agents, the vanadium being present in an amount from about 0.03% by weight to about 0.3% by weight.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. A method of forming tools by severe cold forming of an alloy steel devoid of machining operations, including the steps of providing a solid metal slug having a predetermined volume, said metal slug being formed of an alloy steel consisting essentially of from about 0.28% to about 0.33% by weight carbon,
from about 0.4% to about 0.7% by weight nickel,
from about 0.4% to about 0.6% by weight chromium,
from about 0.15% to about 0.25% by weight molybdenum,
from about 0.25% to about 0.65% by weight manganese,
up to about 0.15% by weight silicon,
from about 0.0005% to about 0.0035% by weight boron,
and the remainder being iron with minor amounts of impurities,
annealing said metal slug for spheroidization to a resultant hardness in the range from about $R_B$80 to about $R_B$76, severe cold forming said annealed metal slug into the final shape of the tool, and thereafter heat hardening said formed tool to a resultant hardness in the range from about $R_C48$ to about $R_C52$.

2. The method of forming tools set forth in claim 1, wherein the manganese in said alloy steel is present in an amount from about 0.4% to about 0.6% by weight.

3. The method of forming tools set forth in claim 1, wherein the silicon in said alloy steel is present in an amount up to about 0.10% by weight.

4. The method of forming tools set forth in claim 1, wherein the boron in said alloy steel is present in an amount from about 0.001% to about 0.003% by weight.

5. The method of forming tools set forth in claim 1, wherein the annealing of said metal slug is carried out by austenitizing at about 1380° F. and holding for three hours at about 1380° F., and thereafter cooling at about 15° F. per hour for about ten hours.

6. The method of forming tools set forth in claim 1, wherein said heat hardening is carried out by austenitizing at about 1625° F. in a 0.3% C. endothermic gas atmosphere, holding at about 1625° F. in said endothermic gas atmosphere for about one hour, thereafter quenching in agitated oil, and thereafter tempering at about 400° F. for about two hours.

7. The method of forming tools set forth in claim 1, wherein the annealing of said metal slug is carried out by austenitizing at about 1380° F. and holding for three hours at about 1380° F., and thereafter cooling at about 15° F. per hour for about ten hours, and said heat hardening is carried out by austenitizing at about 1625° F. in a 0.3% C. endothermic gas atmosphere, holding at about 1625° F. in said endothermic gas atmosphere for about one hour, thereafter quenching in agitated oil, and thereafter tempering at about 400° F. for about two hours.

* * * * *

UNITED STATES PATENT AND TRADEMARK OFFICE

CERTIFICATE OF CORRECTION

PATENT NO. : 4,319,934

DATED : March 16, 1982

INVENTOR(S) : Gary S. Henning

It is certified that error appears in the above-identified patent and that said Letters Patent are hereby corrected as shown below:

Column 10, line 67, "$R_B80$" should be --$R_B70$--.

Signed and Sealed this

*Third* Day of *August 1982*

[SEAL]

*Attest:*

GERALD J. MOSSINGHOFF

*Attesting Officer*

*Commissioner of Patents and Trademarks*